US007249655B1

(12) United States Patent
Colet

(10) Patent No.: US 7,249,655 B1
(45) Date of Patent: Jul. 31, 2007

(54) UTILITY TRUCK SERVICING LARGE AIRPLANES

(76) Inventor: Ralph Colet, 38021 Cherry St., Newark, CA (US) 94560

( * ) Notice: Subject to any disclaimer, the term of this patent is extended or adjusted under 35 U.S.C. 154(b) by 608 days.

(21) Appl. No.: 10/759,887

(22) Filed: Jan. 16, 2004

(51) Int. Cl.
*A62B 1/20* (2006.01)
*E06C 5/00* (2006.01)
*E04C 1/00* (2006.01)

(52) U.S. Cl. ..... 182/63.1; 182/127; 182/49

(58) Field of Classification Search ..... 182/48, 182/63.1, 47, 40, 43, 42, 127; 193/6, 16, 193/25 B, 25 R
See application file for complete search history.

(56) References Cited

U.S. PATENT DOCUMENTS 3,088,542 A * 5/1963 Johnson et al. ..... 182/48
4,050,542 A * 9/1977 Wilson ..... 182/49
4,099,595 A * 7/1978 Tracy ..... 182/48
4,339,019 A * 7/1982 Tracy ..... 182/48
4,577,725 A * 3/1986 Hunter ..... 182/48
4,580,659 A * 4/1986 Baker ..... 182/48
4,589,519 A * 5/1986 Hunter ..... 182/48
4,606,431 A * 8/1986 Ruder, Sr. ..... 182/49
4,650,034 A * 3/1987 D'Avanzo ..... 182/49
4,962,827 A * 10/1990 Garnett ..... 182/63.1
5,555,953 A * 9/1996 Henderson ..... 182/63.1
6,408,982 B2 * 6/2002 Bockhold ..... 182/48
6,460,653 B1 * 10/2002 Hardy et al. ..... 182/63.1

* cited by examiner

*Primary Examiner*—Hugh B. Thompson, II
(74) *Attorney, Agent, or Firm*—Robert Samuel Smith

(57) ABSTRACT

An all purpose utility vehicle supporting rescue efforts especially directed toward servicing disable airplanes being an entry tube having a cab section and a tail end section. Mechanisms are provided for inclining the tube so that the cab section is elevated to the level of an airliner permitting personnel to enter the lower end of the tube and walk up to the cab section and into the stricken airplane. A gangplank design for joining the cab section to the tail section provides that the floor of the cabin section is always horizontal regardless of inclination of the tail section.

28 Claims, 11 Drawing Sheets

UTILITY TRUCK SERVICING LARGE AIRPLANES

FIELD OF THE INVENTION

This invention relates to trucks especially dedicated to servicing large disabled grounded airliners and particularly a utility truck that facilitates admission into the airplane of men and equipment that are dedicated to overcoming any number of dangerous conditions on the airplane and, in particular to facilitate dealing with incapacitated passengers on the plane.

BACKGROUND AND INFORMATION DISCLOSURE

Dealing with catastrophic events involving airplanes has become much more challenging in recent years.

Certainly, the present crises regarding terrorist activities have broadened the scope of the disasters that can befall the airplane and it passengers.

Progress in the evolution of air travel has included the development of airplanes that are much larger than counterparts of former times in keeping with the requirement to carry hundreds of passengers. In particular, the access from ground level to the largest of these planes is a doorway near the cockpit that is 26 feet off the ground. In addition, there is also in service, smaller planes that still carry a substantial number of people where the door to the plane near the cockpit) is only a few feet off the ground. The problem of getting out of airplane where the doorway is only a few feet off the ground is different than when the doorway is 26 feet off the ground.

The problem of ventilating a disabled plane containing 250 passengers is more difficult than ventilating a plane with one-tenth that number.

The circumstances vary from one situation to another and are unanticipated by the rescuing personnel. One situation may be a passenger suffering from a heart attack who must be removed as quickly and gently as possible. Another situation could be where the plane has come under the control of a band of terrorists. Another situation might be a fire that has broken out in the cockpit.

Vehicles have been designed to deal with each of these various catastrophes. Ambulances have been designed to transport victims of heart attacks. Fire engines have been designed to fight fires. Military vehicles have been designed to support swat teams.

New advances in aircraft design have included the increase of size of the latest airliners where the doorways are up to 26 feet off the ground. The differing nature of all of these situations have left the protection of airplanes in a situation where none of the utility vehicles presently on the market can accommodate all of the events that can befall the modern airplane.

An important requirement for large utility trucks is to include sufficient power to drive both the truck and the added equipment required to deal with the catastrophe. Additional equipment can include pumps to pump water to fight fires. According to the present trend in the state of the art, utility trucks are provided with larger and larger engines whose size requires that the engine be located on the truck frame ABOVE axle level. In order to accommodate both the requirement to move the truck AND power the auxiliary equipment, a power transfer device is coupled to the motor that delivers part of the engine power to driving the truck and another part of its power to powering the auxiliary equipment when required. The large engine and transfer case on top of the frame occupies space on top of the frame that would otherwise be used for carrying additional auxiliary equipment.

The uncertain nature and disparity of events and the unusual power requirement of utility trucks of the present art suggests that there exists a profound need for a more versatile and less costly utility vehicle.

SUMMARY OF THE INVENTION

It is an object of this invention to provide a utility vehicle that supports a rescue effort in any kind of crisis situation.

Such situations include fire, efficient removal of stricken passengers, support for swat teams whose mission is to overcome terrorists, provide speedy escape to passengers, provide relief to passengers exposed to uncomfortable environmental conditions, facilitate transport of afflicted passengers to an appropriate care facility.

It is another object that the vehicle of this invention be economical not only in terms of serving a number of purposes but also in terms of delivering a given amount of power economically.

This invention is directed toward a truck in which the cab of the truck communicates with and is a forward part of a tubular member that extends back to the tail end of truck. The tubular member has a rectangular cross section, about four feet wide and seven feet high so that a man can walk through the tube from the tail end to the cab end.

The tubular member has its tail end hingeably attached to the tail end of the truck so that the front end of the tubular member (which includes the cab) can be raised to a height of 26 feet. This height accommodates all present and near future airliners The cab end of the tube can be raised to any height between horizontal to 26 feet off the ground. At this height, a person or persons, entering the open tail end of the tube at ground level can walk up to the cab end of the tube, open the door to the airplane cabin and enter the airplane.

The adjustable height of the cab provides that the height of the cab end off the ground may be adjusted so that the floor of the cab end is any where from three feet for entering small aircraft to 26 feet for entering for the latest airliner.

A stairway extends from the tail end of the tube to the cab. The stairs are constructed to permit that, regardless of the selected incline of the tube, the stepping plane of each step is horizontal. The construction of the stair also provides that the stair can be instantly flattened out onto the inside lowest surface of the tube when it is desired to use the tube as "chute" or it is desired to roll a gurney down the entire length of the tube and outside the tube to a waiting ambulance.

A stair is also mounted on the upper external surface of the truck as an alternate means for travelling the length of the tube.

The steering wheel inside the cab is coupled to the steering box in the frame of the vehicle by a rotatable pipe that extends from the steering wheel in the cab, down the length of the tube, to the steering gears and knuckle inside a steering unit that is coupled to the steerable wheels.

The brake pedal controls air pressure in flexible air hose that control the pneumatic brakes.

The accelerator pedal is wired to the electronically controlled engine.

The flexible air lines and accelerator wiring are connected between the cab and motor by passing down the tube or by a direct connection that feature a device that retracts (winds up) slack in the wiring and airline according to the incline of the tube.

The cab end of the tube is constructed of a transparent impact resistant material such as glass or polycarbonate plastic to provide maximum visibility (especially to the driver) to the occupants in the cab. The cab end of the tube is preferably large enough to permit several occupants to ride in the cab. Alternatively, several occupants can ride in the tube.

The rest (tail end) of the tube is made of a sturdy structural material that is opaque providing that, when required, e.g., in hostage situation, swat team members could hide in the tunnel and burst forth into the open door of the plane in a surprise attack on the plane occupants.

The front door (on the front end of the tube) is preferably a sectionalized transparent member. The door is hinged on one edge to the end of the tube and swung open as the cab end of the tube approaches the side of the airplane. Crew seats are in the cab.

In operation, the cab end of the tube is raised to the height of the airplane door, the door on the cab end of the tube is opened toward the outside of the cab. Then the truck is driven a few feet so that the now open front end of the tube is flush against the side (including the door) of the airplane. The door of the airplane is opened toward the outside of the plane.

When the door of the plane is open, the inside of the tube is in unobstructed communication with the inside of the airplane.

A feature of this invention is a "gangplank construction" of the floor of the cab which maintains the floor level so that any one of the following actions can occur:

Medics can roll a gurney between the tube and the interior of the plane and out of the tail end of the tube to a waiting ambulance.

Fire fighting equipment can be rushed from the tube into the plane.

A hose can be rushed through the tube directly to the entrance to the airplane.

A previously concealed swat team can swarm from inside the tube into the plane to engage terrorists.

When closed, the door on the front of the cab provides protection against the weather to cab occupants as the truck is driven down the highway.

An important feature is the mounting of two engines mounted between the front and rear axles below the level of the frame supporting the horizontal tube. One engine is mounted close to and is coupled to the rear wheels. The other engine is mounted close to and is coupled to the front wheels.

This arrangement has several important advantages compared to the design of the present art where one large motor with a power dividing device coupled between the motor and wheels.

One advantage of this feature of the invention is that one large motor (of the present art) is more expensive than two small motors (the present invention).

A second advantage is that the smaller motors can be conveniently mounted under the truck bed frame rather than on top of the frame. The location of the motors UNDER the frame leaves space on TOP of the frame that is available for storing equipment (fire extinguishers, pumps, etc., hose, etc.)—a more efficient use of the space particularly in terms of accessibility to the operators.

A third advantage of substituting two motors under the frame for one large motor on top of the frame is that one of the two motors can be coupled to driving one axle and recoupled to power the auxiliary equipment when required while leaving to the other motor the job of driving the truck.

It should be noted that, when the one motor is powering the auxiliary equipment, the truck will generally be moving at low speed or not at all so that moving the truck can be accomplished by only the one other engine.

The foregoing summary has highlighted features, aspects and advantages of the present invention. The invention is further explained by the following description of what I presently believe to be the best mode for carrying out the invention illustrated by drawings to which are appended claims which define the scope of the invention.

BRIEF DESCRIPTION OF THE DRAWINGS

In FIG. 5*a*, the stairs are arranged with the step platform horizontal. In FIG. 5*b*, the steps are flattened against the floor of the tube such as when it is required to roll a gurney down the tube.

DESCRIPTION OF A BEST MODE

Figure 1:
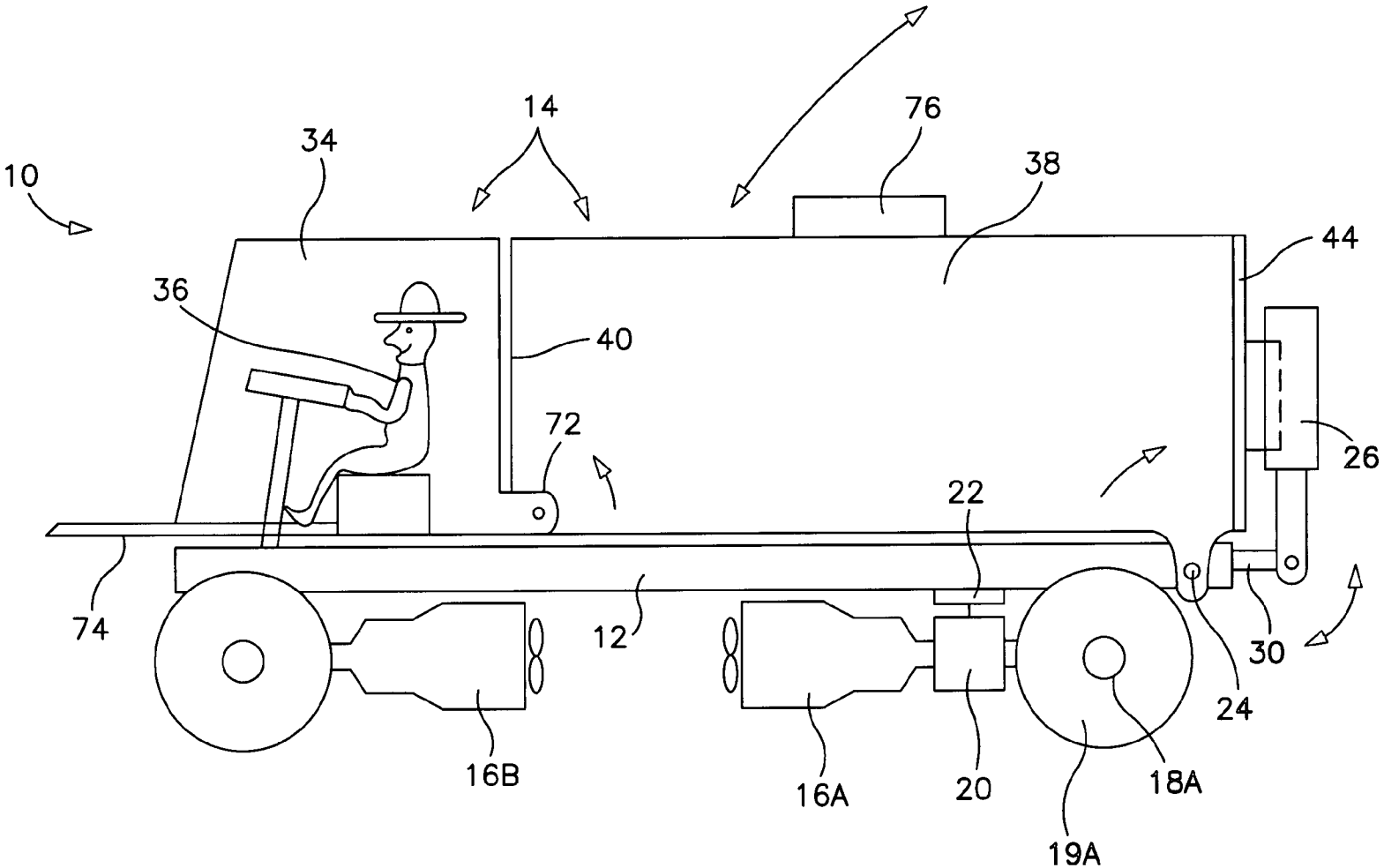
FIG. 1 shows a side view of the utility truck of this invention with the entry tube in the "down" position.

Turning now to a discussion of the drawings, FIG. 1 shows the utility vehicle 10 of this invention including a truck bed 12 carrying an entry tube 14. The tube is in the "down" position in FIG. 1

Figure 2:
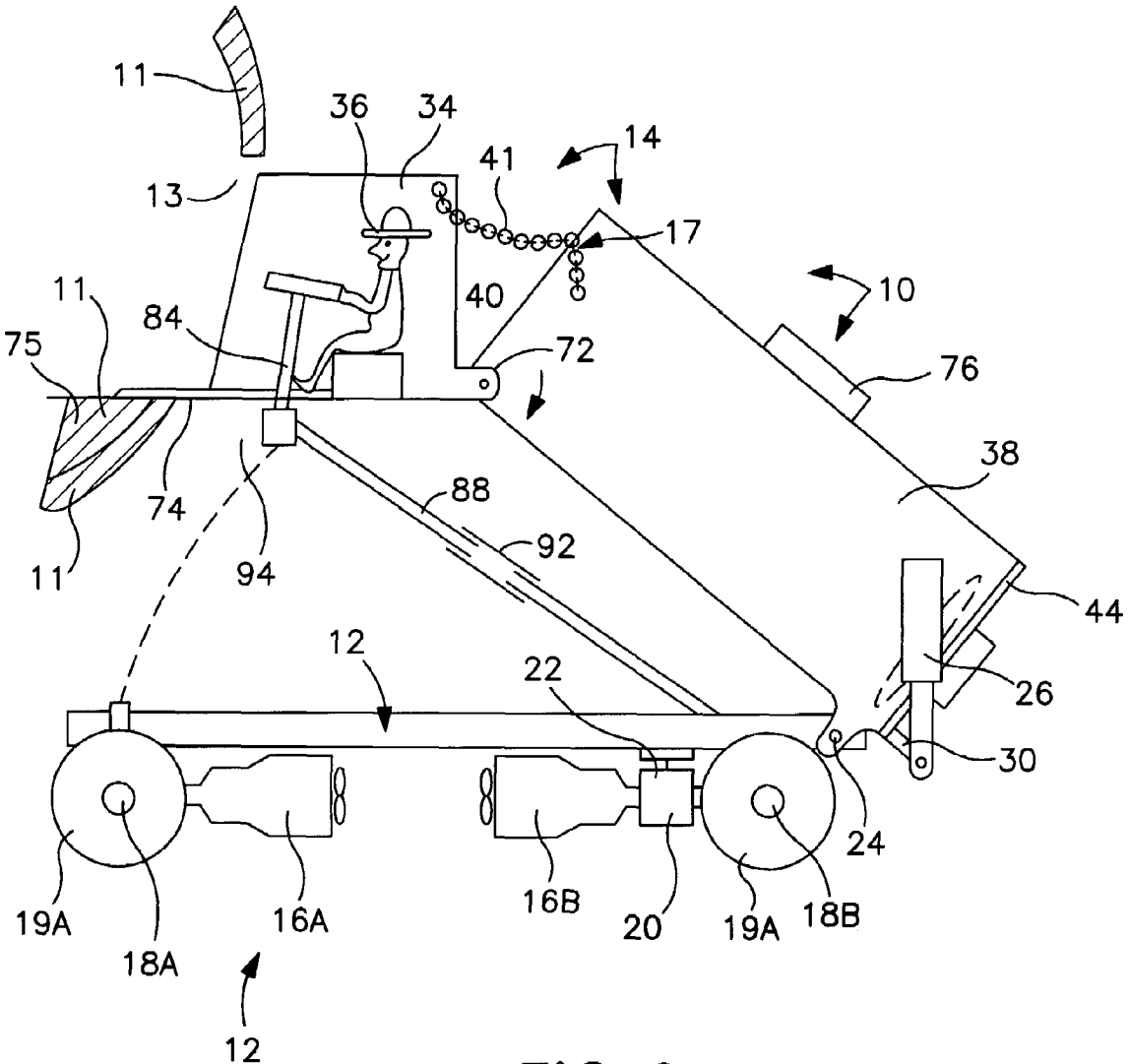
FIG. 2 shows a side view of the utility truck of this invention with the entry tube in the "up" position.

FIG. 2 shows the tube 14 with the front end elevated up to a height matching the distance of the airplane entrance 13 off the ground. A sectional cutaway view of the airplane 11 is shown in FIG. 2. The entry tube 14 is shown positioned against the airplane 11.

Figure 3:
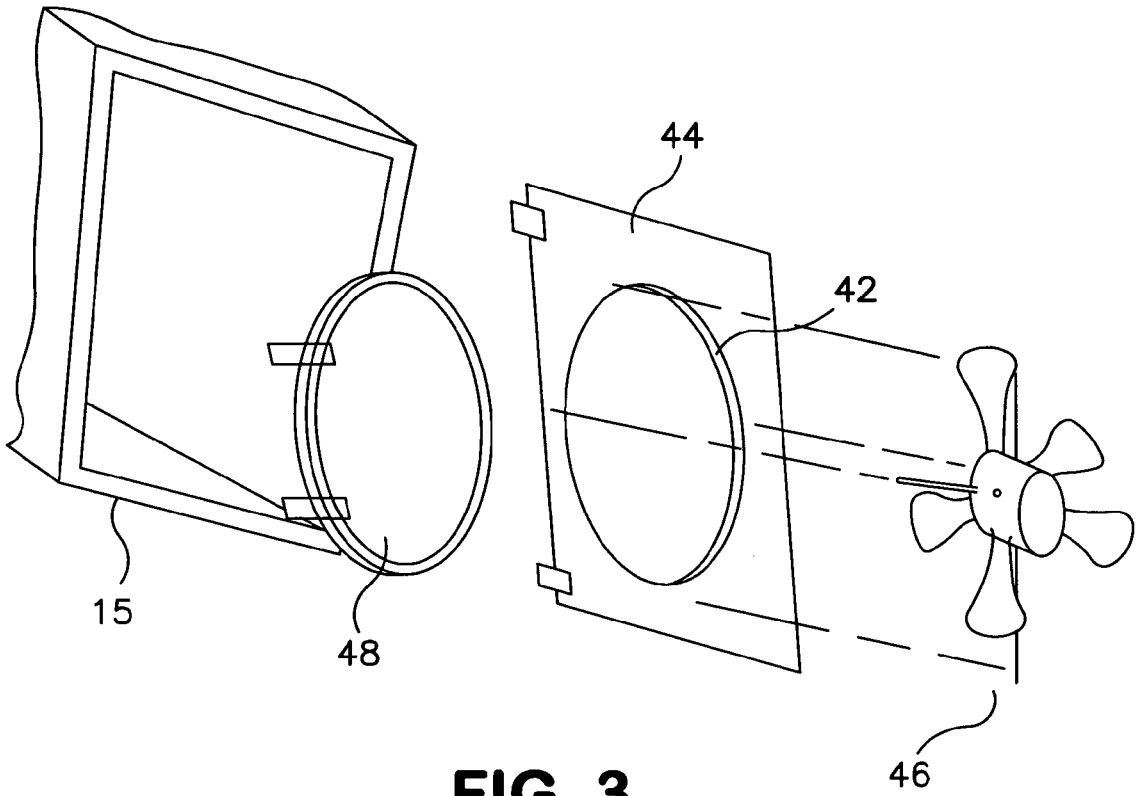
FIG. 3 shows a fan mounted on the outside of the end door and a smaller door mounted on the end door.

As shown in FIGS. 1, 2, the floor of the cab section is a gang plank that is hingably attached to the tail section to pivot about center 72 adjacent the top step in the tube. The gang plank 74 (floor of the cab section) pivoting FIG. 3 shows a fan mounted on the outside of the end door and a smaller door mounted on the end door.

Figure 4:
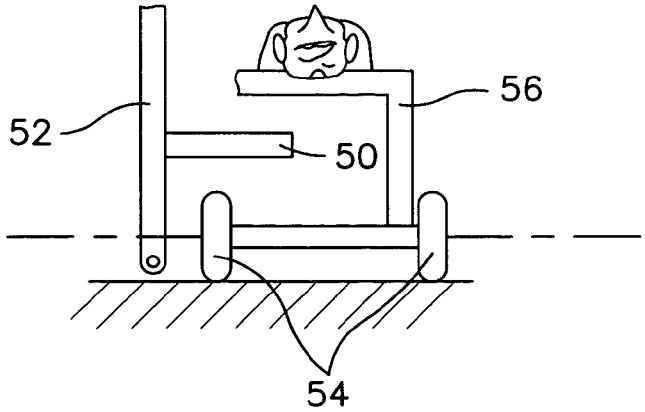
FIG. 4 shows an end view of the gurney rolling through the cab section and avoiding interference with the seat of the driver.

FIG. 4 shows an end view of the gurney rolling through the cab section and avoiding interference with the seat of the driver.

Figure 5A:
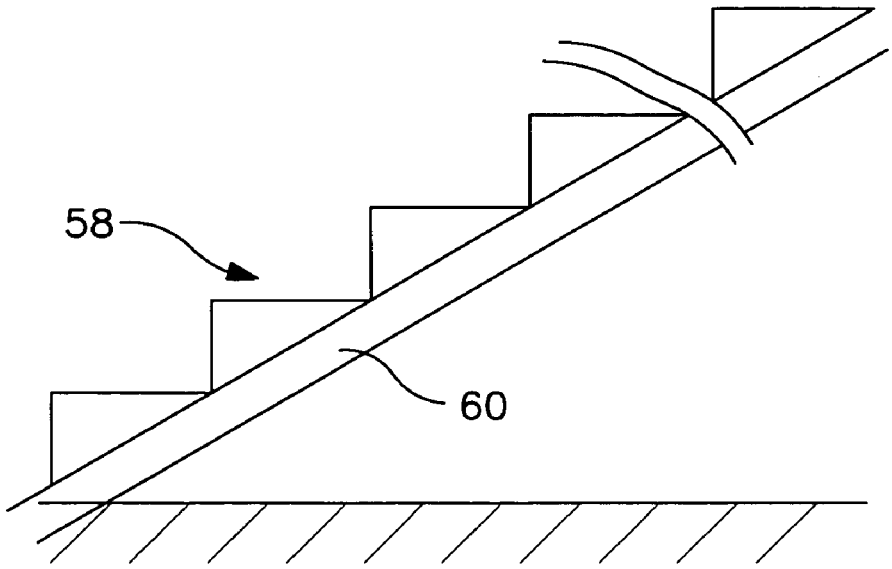
FIGS. 5*a* and 5*b* are sectional views of the stair inside the cab.
Figure 5B:
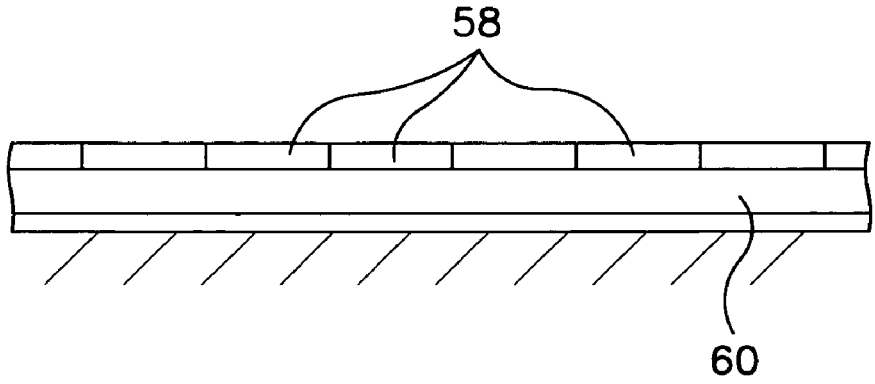

FIGS. 5*a* and 5*b* are sectional views of the stair inside the cab. In FIG. 5*a*, the stairs are arranged with the step platform horizontal. In FIG. 5*b*, the steps are flattened against the floor of the tube such as when it is required to roll a gurney down the tube.

Figures 6, 7:
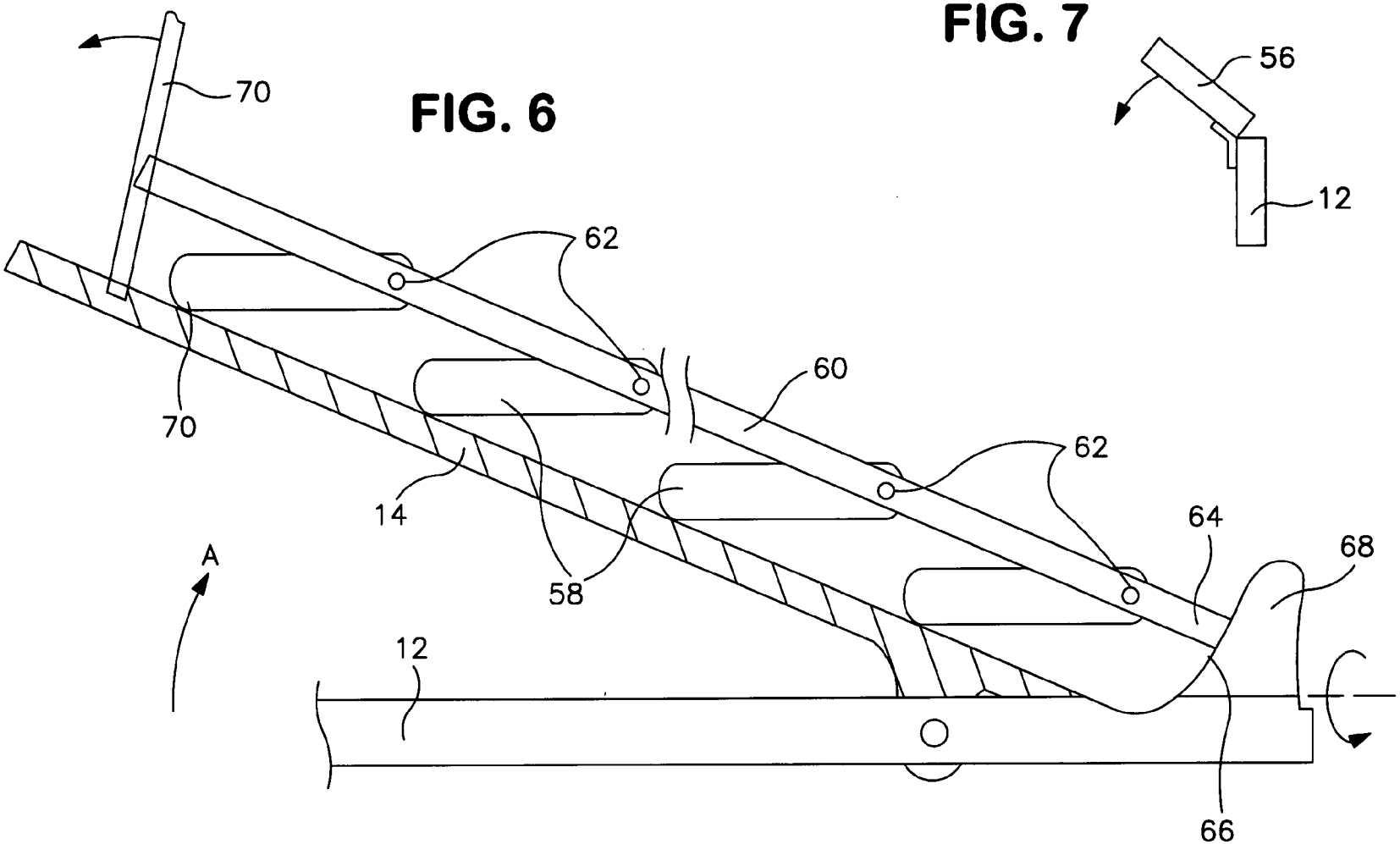
FIG. 6 shows the construction of the stairs for selecting the inclination of the step platform.
FIG. 7 shows the arrangement for collapsing the steps when required.

FIG. 6 shows the construction of the stairs for selecting the inclination of the step platform.

FIG. 7 shows the arrangement for collapsing the steps when required.

Figure 8:
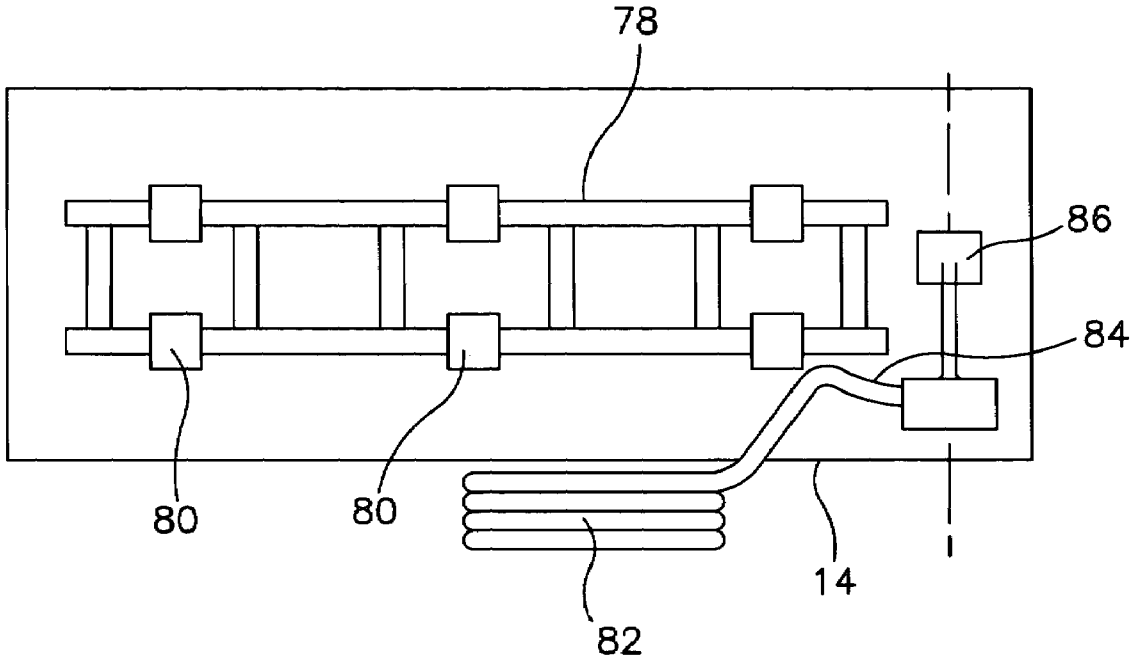
FIG. 8 shows a ladder mounted on the outside of the entry tube.
Figure 11:
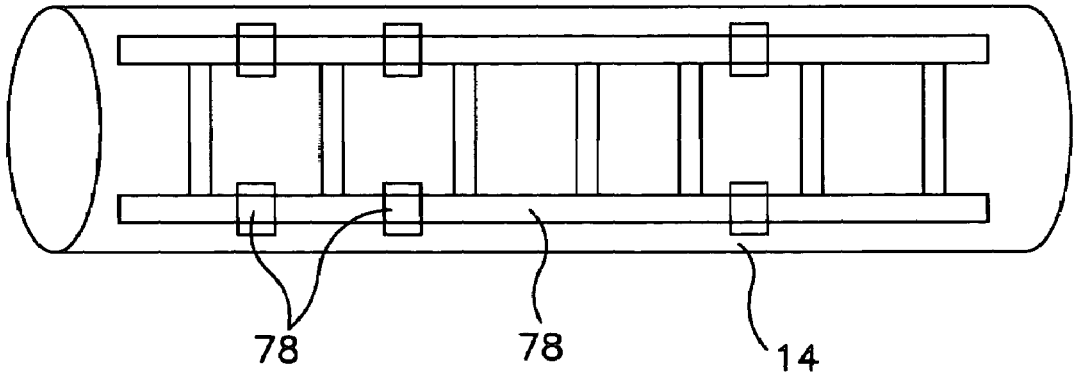
FIG. 11 shows a ladder on a tube small enough to enable one man to carry it.

FIG. 8 shows a ladder mounted on the outside of the entry tube.

Figure 9B:
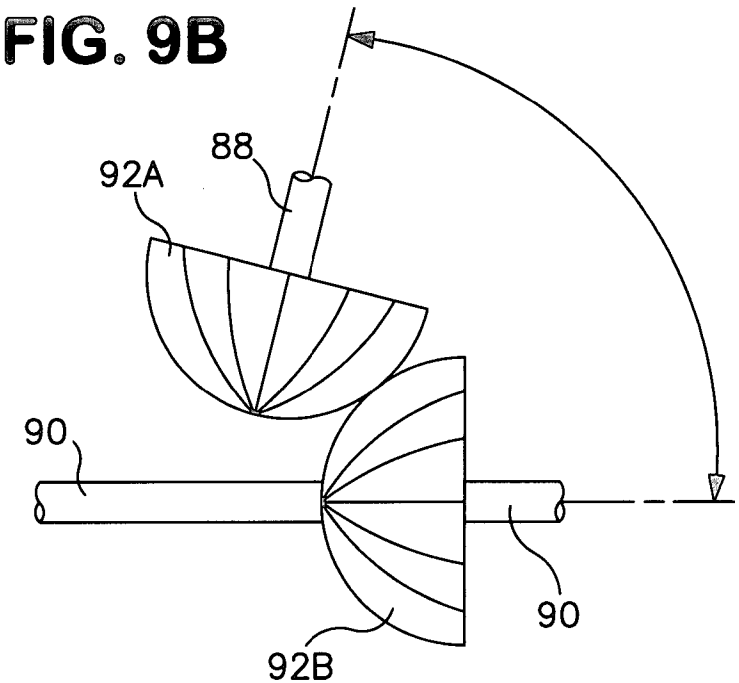
FIGS. 9A, B show details of the coupling of the coupling rod to the steering shaft.
Figure 9A:
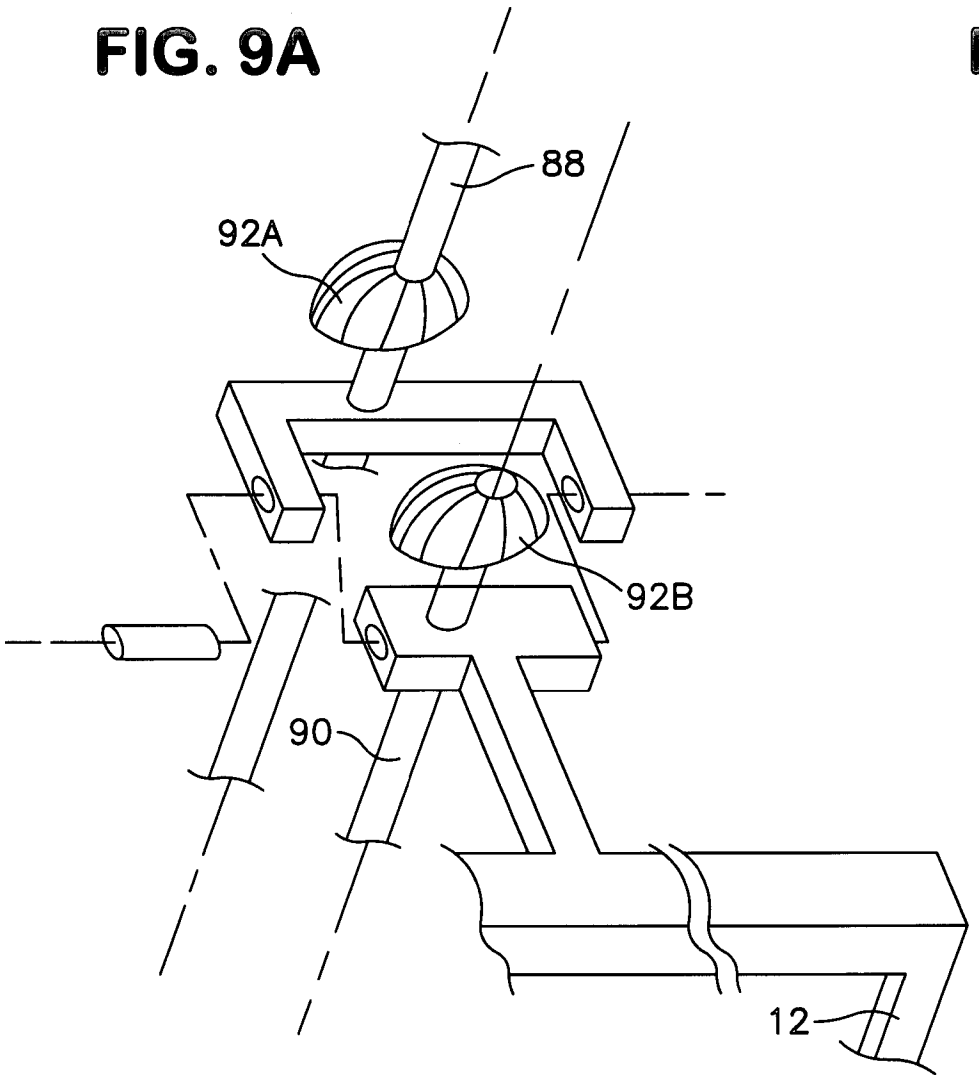

FIGS. 9A, B show details of the coupling of the coupling rod to the steering shaft.

Figure 10A:
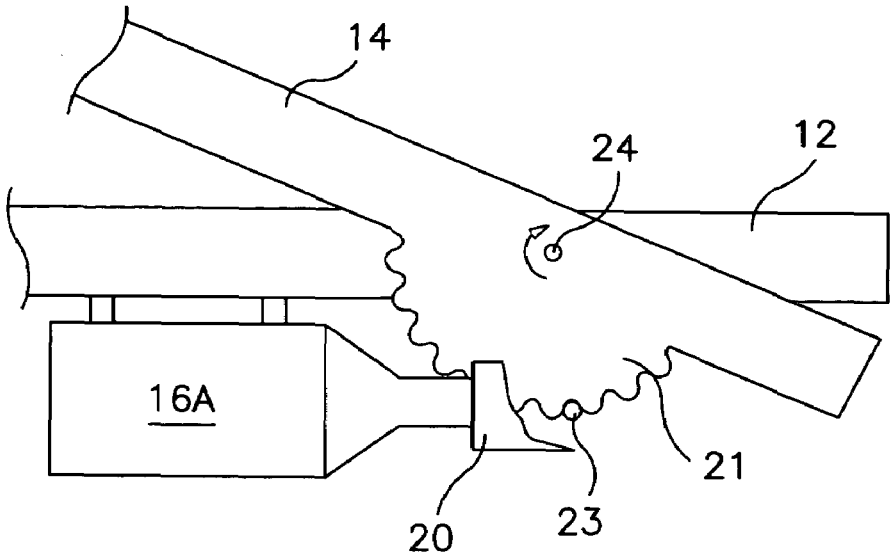
FIGS. 10A, B show a mechanical embodiment for raising the cab section (tilting the entry tube).

FIGS. 10A, B show a mechanical embodiment for raising the cab section (tilting the entry tube).

DESCRIPTION OF A BEST MODE

Turning now to a discussion of the drawings, FIG. 1 shows the utility vehicle 10 of this invention including a truck bed 12 carrying an entry tube 14. The tube is in the "down" position in FIG. 1

FIG. 2 shows the tube 14 with the front end elevated up to a height matching the distance of the airplane entrance 13 off the ground. A sectional cutaway view of the airplane 11 is shown in FIG. 2. The entry tube 14 is shown positioned against the airplane 11.

As shown in FIG. 1, 2, the floor of the cab section is a gang plank that is hingably attached to the tail section to pivot about center 72 adjacent the top step in the tube. The gang plank 74 (floor of the cab section) pivoting about cab pivot center 72 drops down until the free end of the gang plank rests on the floor 75 of the plane well inside the cockpit. The gangplank (cab floor) is thereby horizontal.

Figure 12A:
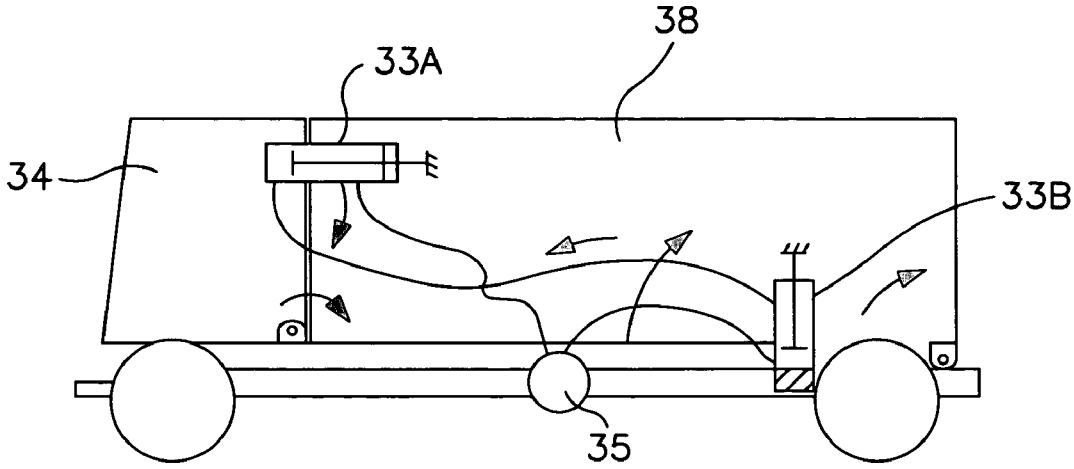
FIGS. 12A, B show a system for supporting the cab section horizontally.
Figure 12B:
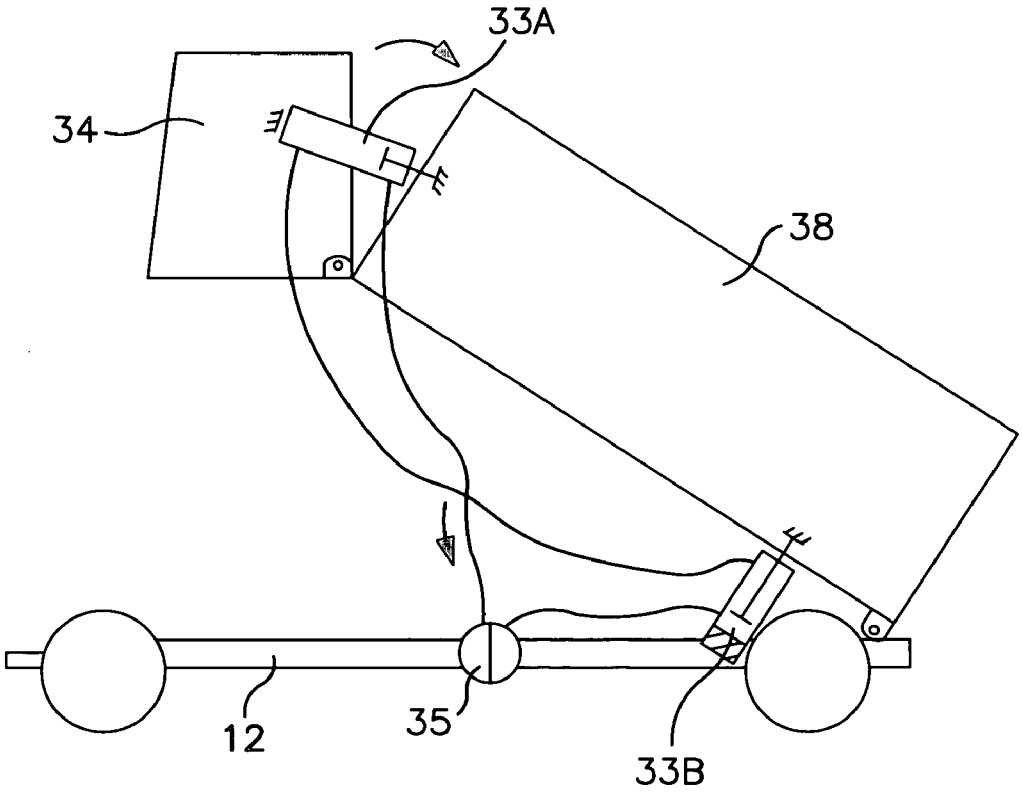

FIGS. 12A,B show a hydraulic cylinder 33A with one end attached to the cab section 34 and the other end attached to the tail section 38. A second cylinder 33B has one end 33B attached to the frame 12 and the other end attached to the tail section 38. To raise the cab section 34, pump 35 forces oil into ram 33B and drains ram 33B. To lower the cab section 34, oil is pumped into ram 33A and drains oil from 33B. This arrangement thereby controls elevation of the cab section and maintains the floor of the cab horizontal This construction thereby provides a large horizontal platform where operators can assemble equipment, load gurneys, etc. in preparation for egress down and out of the tube.

FIGS. 1, 2 also show a pair of engines 16 A,B. Each engine is located beneath the frame 22 close to the ground and between the front and rear axles. One engine 16A is located close to and coupled to the rear wheel axle 18A. The other engine 16B is located close to and coupled to the front wheel axle 18B.

A transmission coupling 20 is shown with which the driver selectively couples the rear engine 16B to the rear axle 18B (for normal driving on the open road) or to auxiliary equipment 22. Transmission splitters such as feature 20 are well known in the art.

The incorporation of two engines is an improvement over the prior art disclosing one large engine which is so large that it must be located above the level of either axle and must be provided with a power transfer device for sending power to both front and back wheels of the truck and the auxiliary equipment.

FIG. 1. 2 also show the arrangement for elevating the cab end of the tube. There is the hinge 24 that couples the tail end of the entry tube 14 to the frame 12

A hydraulic ram 26 is mounted on the rear end of the entry tube 14. When the ram 26 is activated, the ram piston 28 presses down on extension 30 thereby raising the front end of tube 14.

Figure 10B:
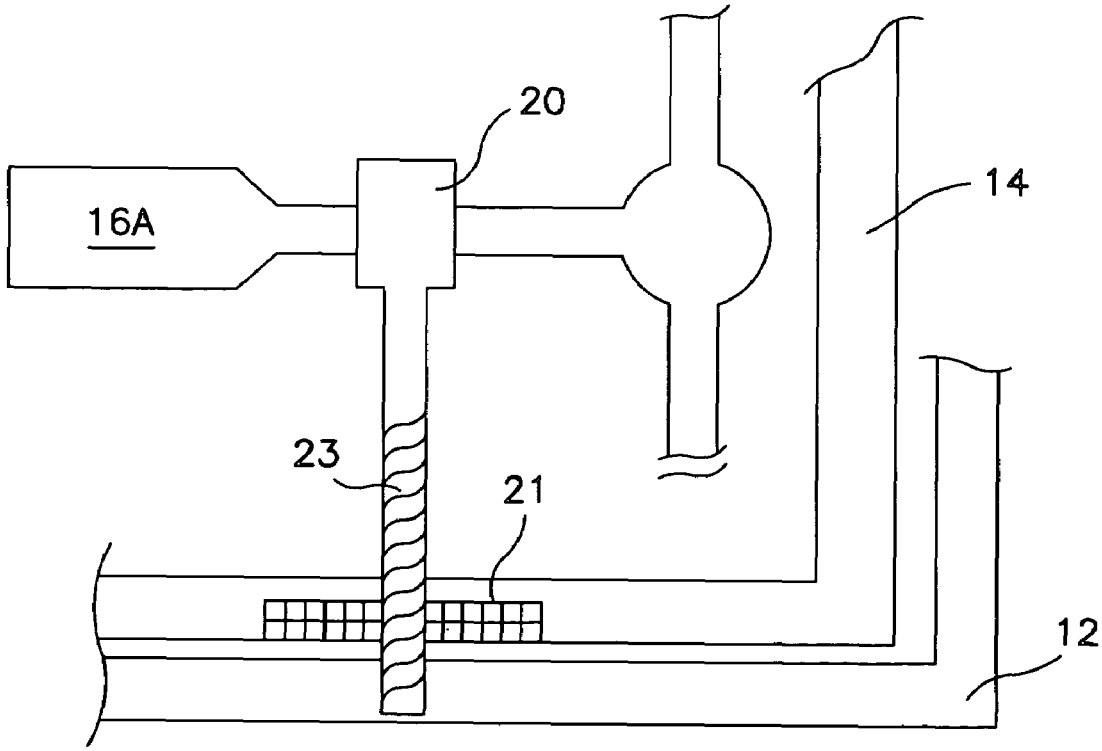

FIGS. 10 A, B is an embodiment showing a mechanical means for raising and lowering the cab end of the entry tube (in place of the hydraulic arrangement 26. FIG. 10A is a side view and FIG. 10B is a bottom view (looking upward from underneath the entry tube 14).

There is shown a partial gear 21 mounted on the entry tube near the tail end. The rear engine 16A is coupled to a right angle clutch 20 which selectively drives a worm gear 21. The worm gear 21 engages a partial; gear 23 which is mounted on the underside of the entry tube 14. When the worm gear is turned by motor 16A, the entry tube rotates about axis 24.

FIG. 2 shows an elongated coupling rod 88 that couples the steering column 84 (in the cab section 34) to a horizontal steering shaft concealed by the frame 12 in FIG. 1,2. A section 92 of the coupling rod 88 is a sleeve telescoped onto opposing sections of the coupling rod 88 to accommodate required changes in the length of the coupling rod as the inclination of the coupling rod 88 is changed.

This invention features several embodiments for steering the truck.

In one embodiment, the steering shaft extends from its coupling to the coupling rod 88 at the tail end of the tube 14 to the cab end of the tube 14 where it is coupled to the front wheels by conventional tie rods. (not shown).

In this embodiment, the truck is steered according to conventional practice.

In another embodiment, the steering shaft 90 is only long enough to be coupled to the rear wheels 18A and the truck is steered by its back wheels.

FIGS. 9A, B show details of the coupling of the steering shaft 90 to the coupling rod 88.

There are shown two hemispherical gears, 92 A,B. Gear 92A is mounted on the very end of the coupling rod 88.

The second hemispherical gear 92B is mounted on the steering shaft 90 near the tail end of the steering shaft 90. The steering shaft 90 is horizontal and is supported by the frame 12.

When inclination of the entry tube 14 is changed, the hemispherical gear 92A "rolls over hemispherical gear 92*b*.

FIG. 2 shows another steering mode, in which the steering column 84 is coupled to a coupler 94 on the end of the steering column 84 that engages a mating coupler 96 that is coupled to the front wheels when the tube 14 is lowered to the horizontal inclination. The steering column is also engaged with the coupling rod 88. The other end of the coupling rod 88 is engaged with an end of the steering shaft as discussed in connection with 10A, B.

In this steering mode all four wheels are steered when the entry tube 14 is horizontal. This mode is especially useful making tight turns.

The entry tube 14 has a door 32 hingeably attached to the tail end of the entry tube 14. The entry tube 14 is preferably about four feet wide and seven feet high. This height and width is sufficient to permit a person to walk through the tube.

A cab section 34 at the front end of the tube 14 is preferably made of transparent panels in order to provide maximum visibility to the driver 36 The transparent panel material is preferably shatterproof glass or a plastic such as a polycarbonate which is not only transparent but also is relatively strong and shatterproof.

The tail section 38 of the tube is made of durable opaque panel—preferably an aluminum alloy. This section 38 of the tube is opaque and a door 40 is positioned inside the tube between the cab section and end section in order that a swat team of a few men may be concealed in the opaque rear section. If necessary, the men may spring from the rear section, through the cab section and into the airplane if aggressive surprise action is required.

FIG. 3 is an exploded view showing details of a door 44 attached to the rear end 15 of the tube 14. The tube 14 is cutaway in FIG. 3 so that only the rear end 15 of the tube. is shown.

A smaller (circular) door 48 is hingably mounted over a central opening 42 in door 44.

A fan 46 is mounted on the outside of the door 44 so that, when the door 44 is open (swung away from the end of the tube 14) the fan 46 is also swung away from the entrance to the tube 14 permitting unobstructed access into the tail end of tube 14.

In one scenario, where there is an urgent need to provide ventilation into a plane (or building) at the cab end of the tube. The door 44 is closed and door 48 is open so that fan 46 is positioned to blow fresh air up through the tube 14 into the airplane cabin or building.

In another scenario for fighting a fire in a remote area where it is necessary to bring water up to the site, the door 44 is closed and smaller door 48 is also closed sealing the opaque section of the tube 14. The door 40 between the cab section 34 and tail section 38 of tube 14 is also closed, The door between the sections and the door on the tail end of the tube are gasketed so that the interior of the opaque end of the tube is sealed. A capped opening is shown on top of the tube. This arrangement permits filling the opaque section of the tube with water when it is required to move a large a quantity of water to the site of a fire.

The opaque section of the tube 14 can now be filled with water or foam forming fire retarding medium and delivered by the truck of this invention to the site of the fire.

FIG. 4 is an end view showing how the drivers seat 50 is supported by attachment to the sidewall 52 and the gurney wheels 54 are arranged to permit rolling a gurney 56 through the cab while avoiding the driver's seat 50. The drivers seat 50 is supported at its edge and is attached to the sidewall 52 such as to permit rolling the gurney 56 to and from the inside of the airplane, past the drivers seat in the cab. The gurney wheels 54 supported on one side of the gurney 56 are shown rolling under the driver's seat 50 thereby permitting the gurney 56 to roll past the driver's seat 50 permitting the gurney to roll into the tail section of the tube and out the open rear door to a waiting ambulance FIG. 5*a* is a sectional view showing a set of stairs 58 arranged down the floor 60 of the tail section of the tube 14. The platform of each step, in combination with the inclining mechanism of the tube, is adjustable so that each step platform remains horizontal regardless of the inclination of the tube.

FIG. 5*b* is a sectional view showing the stairs flattened against the floor of the tube when it is required to roll a gurney down the entire length of the tube.

FIG. 6 shows the construction for maintaining the level stair platform. There are shown the truck frame 12 (cutaway) and a sectional view of the floor of the tube 14. (cut away). One tie rod 60 of a pair of tie rods is shown. One tie rod is 60 is pivotally mounted onto pivoting center 62 on one edge of each step 58 and the other tie rod on the opposite edge of the step. The end 64 of the tie rod 60 slidably abuts the surface 66 of cam 68.

As shown in the end view, FIG. 7, of cam 68 is spring mounted to stand erect on frame member 12. As the tube 12 is tilted upward (arrow A), tie rod 60 engaging each step 58 causes the distant edge 70 of each step 58 to slide against the surface of tube floor 14. Cam surface 66 is selected to maintain each step 58 regardless of the angle of inclination of the floor of the tube 14.

If it is required to flatten the steps so as to roll a gurney down the tube, cam 56 is rotated about hinge 57 (FIG. 7) by a handle (not shown) on cam so that the steps collapse flat onto the tube floor 14.

To reposition the steps 58, a lever 70 attached to the tie rod at a midpoint location and having its fulcrum end attached to the tube 14, is pulled to retract the end 64 of the tie rod 60 and permit the spring loaded cam 68 to snap back to its original position abutting the end 63 of tie rod 60. Each tie rod 60 is hingeably attached to a respective edge of each step.

Figure 13A:
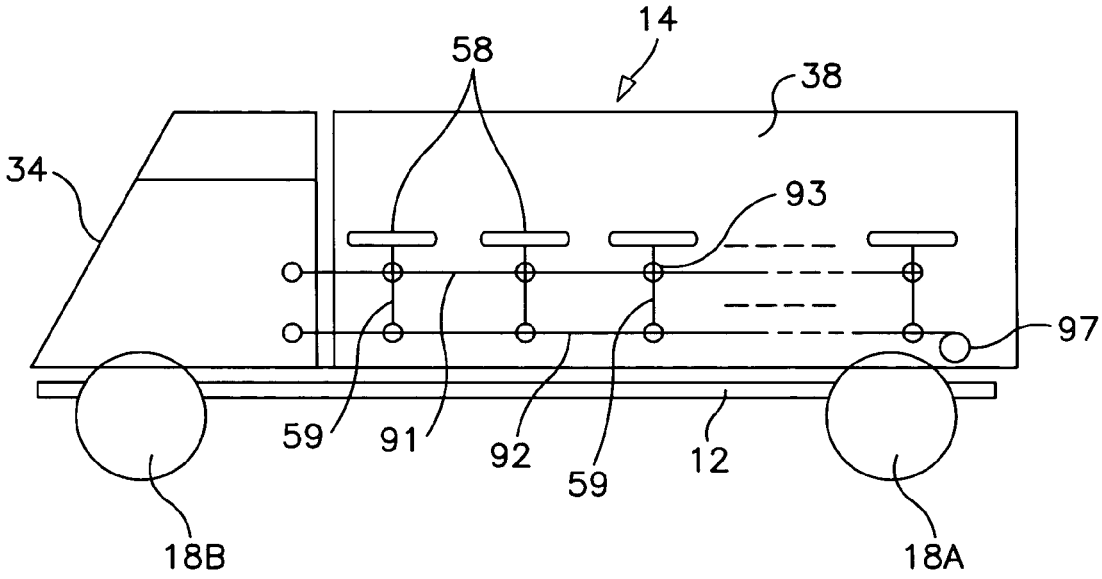
FIGS. 13A, B show another method for maintaining the steps horizontal.
Figure 13B:
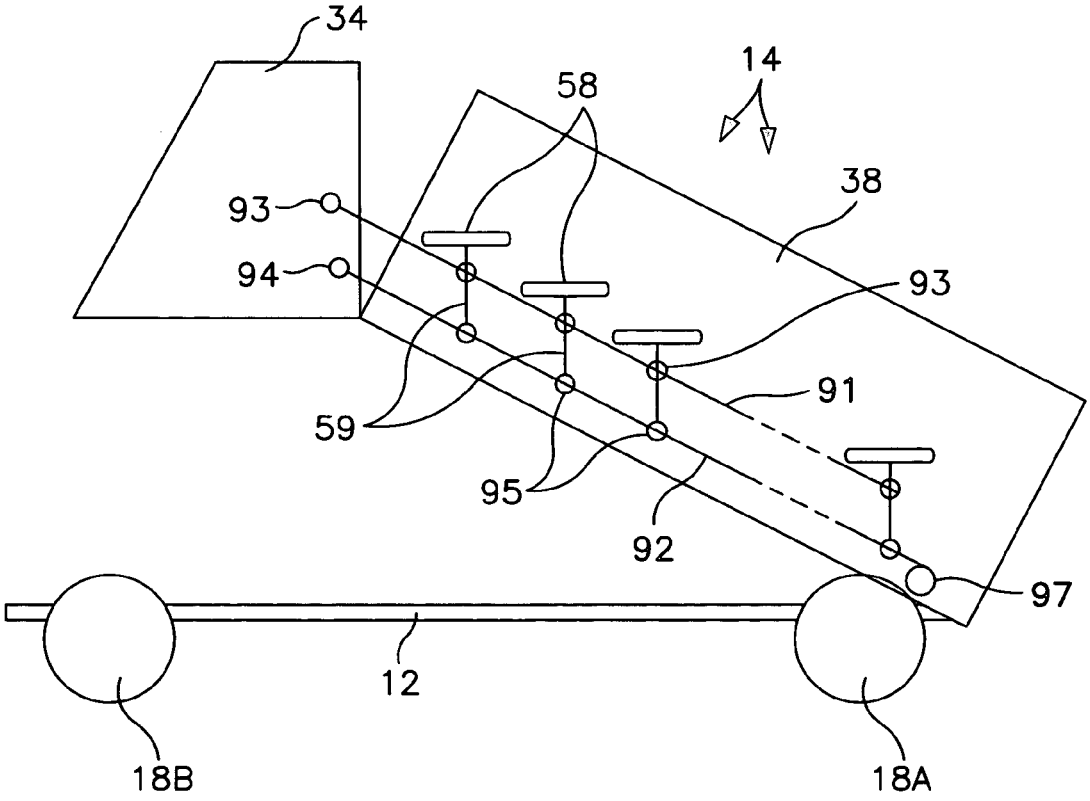

FIGS. 13A, B show another arrangement for maintaining the steps 58 in a horizontal orientation. There are shown a an upper connecting rod 91 and a lower connecting rod 92. Each connecting rod has respective ends, 93 and 94, hingeably attached to cab section 34. Each step 58 is mounted on vertical support rods 59. Each support rod 59 has a rotatable attachment 93 to the upper connecting rod 91 and a rotatable attachment 95 to the lower connecting rod 92. A roller 97 attached to the end of the lower connecting rod enables the end of the lower connecting rod 92 to roll on the floor of the tail section as the tube 14 is tilted so as to raise the cab section 34. The floor of the cab section 34 is maintained horizontal.

The door on the front of the cab section must not interfere with driving the cab end of the tube flush against the doorway opening of the airplane. Since it can not be predicted where the wing of the airplane will be (right or left side of the tube) or what obstruction may overhang the tube, a sectionalized door that folds up or rolls up inside the cab over the head of the driver is preferred. Sectionalized doors such as used on garages are well known in the art.

FIG. 8 is an embodiment showing a ladder 78 slidably mounted in retaining channels 80 on the outside of the tube 14. A coiled fire hose 82 is mounted on the tube 14 and the end 84 of the hose 82 is attached to the upper end of the ladder 78. The ladder 78, parallel to the tube, is tilted as the tube is tilted and, when extended, is leans out over whatever (the airplane) is below.

The ladder is extended by applying power to a capstan 86.

A firefighter can climb the ladder and, when he reaches the end of the ladder, direct the water from the hose onto the fire below.

There has been described a utility truck that can support an operation to overcome a variety of catastrophes.

These catastrophes include fires, medical emergencies, hijackings, forced landings, etc.

Variations and modifications of this invention may be contemplated after reading the specification and studying the drawings that are within the scope of the invention.

Figure 14:
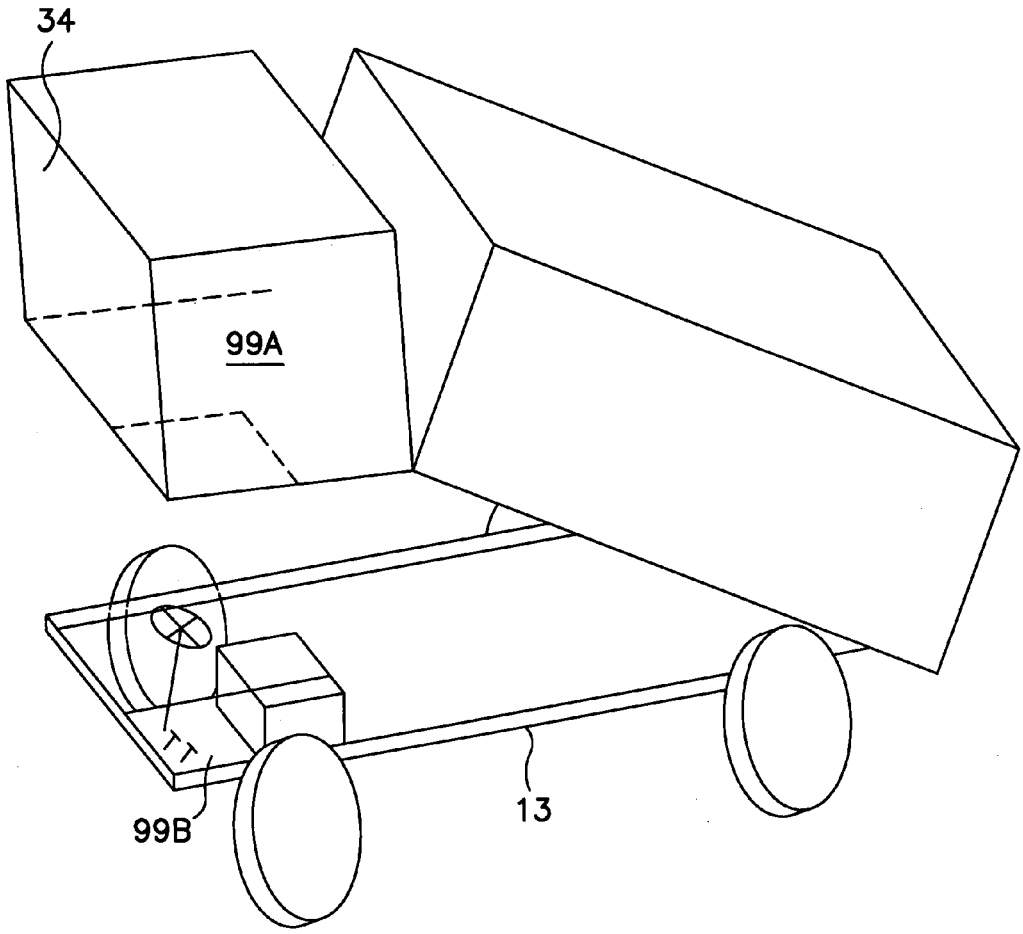
FIG. 14 shows the sectionalized cab floor.

For example, FIG. 14 shows a version of the invention in which the floor of the cab section 34 is divided into two parts. One part 90A is a part of the cab section that is raised. The other part 99B is permanently mounted on the frame 13. All of the controls, steering wheel, brakes, accelerator, etc. and the driver are mounted on the stationary section so that the driver remains at ground level as the entry tube is tilted.

However, the floor section 99B is raised so as to provide the working space at the elevated level of the airplane cabin.

In view of these and other versions, I therefore wish to define the scope of my invention by the appended claims.

I claim:

1. A utility vehicle which comprises:

an entry tube having a cross sectional size selected to enable a person to walk inside said tube from one end of said tube to another end;

means for supporting said entry tube on a plurality of wheels;

said entry tube having a free end and a pivotal end pivotally attached to one end of said means for supporting;

means for raising said free end of said entry tube to a height above a ground support surface of said utility vehicle by pivoting said entry tube around said pivotal end;

means for controlling raising said entry tube and for steering and driving said entry tube mounted on said means for supporting;

said means for controlling proximal to said free end.

2. The utility vehicle of claim 1 wherein said entry tube has a rectangular cross section having a height that is vertical and a width that is horizontal when supported on said means for supporting.

3. The utility vehicle of claim 2 wherein said entry tube comprises:

a tail section having a pivotal end pivotally attached to pivot axis mounted on a rear end of said means for supporting;

a cab section having means for hingeably attaching said cab section to said opposite end of said tail section;

said cab section containing said means for controlling.

4. The utility vehicle of claim 3 wherein said cab section comprises:

a cab floor having an edge hingably attached to said tail section adjacent said opposite end and arranged to provide that a floor of said cab section is continuous with a floor of said tail section arranged to permit rolling a gurney conveniently from said cab section into said tail section.

5. The utility vehicle of claim 4 comprising:

a hydraulic first ram with one end attached to said cab section and another end attached to said tail section;

a hydraulic second ram having one end attached to said frame and another end attached to said tail section;

a pump arranged to force oil into said first ram and drain oil from said second ram to raise cab section and to pump oil into said first ram and drain oil from said second ram whereby said cab section is lowered;

said pump and rams operably arranged to control elevation of said cab section and maintain said floor of said cab horizontally oriented.

6. The utility vehicle of claim 4 wherein said cab extends beyond said cab section.

7. The utility vehicle of claim 4 comprising a safety chain having one end secured to said cab section and means for attaching said safety chain to said tail section at a selectable location on said safety chain.

8. The utility vehicle of claim 4 further comprising a plurality of steps being a stair inside said tail section and extending from where said cab section is joined to said opposite end of tail section to said pivoting end of said tail section.

9. The utility vehicle of claim 8 wherein said stair comprises a plurality of steps, each step arranged to be horizontal independent of inclination of said entry tube.

10. The utility vehicle of claim 9 wherein said stairs comprise:

an upper connecting rod;

a lower connecting rod;

each said connecting rod having respective ends, hingeably attached to said cab section;

each step mounted on two vertical support rods;

each support rod is rotatably attached to said upper connecting rod and lower connecting rod;

a roller attached to an end of said lower connecting rod whereby an end of said lower connecting rod is enabled to roll on a floor of said tail section as said tube is tilted to raise said cab section and providing that a floor of said cab section is maintained horizontal.

11. The utility vehicle of claim 9 wherein:

each step of said plurality of steps has a pair of short edges defined by a width of said step and a pair of long edges defined by a length of said step, and said stair further comprises:

a pair of tie rods, each said tie rod having a length about the same as a length of said tail section of said entry tube;

said each tie rod having a row of apertures, one aperture for each step and evenly spaced apart from its neighboring aperture by a distance equal to about said width;

a pin through each said aperture and into a hole in said short edge of a respective edge of said step whereby each said step is rotationally pinned to each tie rod;

a pair of cams, each said cam for one side of said entry tube opposite said other cam on an opposite side of said entry tube;

each said cam having a cam surface and mounted on said frame proximal to said tail end of said tail section of said entry tube;

each said tie rod having a lower end abutting a respective one of said cam surfaces;

said pair of tie rods with respective rows of apertures, said pair of tie rods, said cam surfaces, all operably arranged to provide that each said step, supported by a respective pair of pins in said tie rods and slidable contact of one of its long edges and a floor of said entry tube, is horizontal regardless of inclination of said tail end of said entry tube.

12. The utility vehicle of claim 11 comprising:

each said cam rotatably mounted on said frame arranged to provide that when said cam is rotated away from said contact with said tie rod, said stair collapses against said floor of said tail end of said entry tube;

each said cam being spring biased against rotation away from said contact with said tie rod;

a pair of levers, one for each tie rod and mounted proximal to said cab section, each lever having one end rotatably attached to said floor of said entry tube and rotatably attached to an end of a respective one of said tie rods;

said pair of tie rods arranged in operable combination with said pair of spring biased cams to provide that, when steps are flat against said floor, said steps are restored to horizontal inclination by pulling on said levers to permit lower ends of said levers to contact said respective cam surfaces.

13. The utility vehicle of claim 3 wherein said means for supporting comprises:

a substantially rectangular frame supported on at least a pair of front wheels mounted on a front axle and a pair of rear wheels mounted on a rear axle; and said means for controlling raising said entry tube and for steering and driving said entry tube mounted on said means for supporting comprises;

a rear motor mounted on said frame between said frame and a ground surface supporting said wheels and between said front wheels and said rear wheels;

a front motor mounted on said frame between said frame and a ground surface supporting said wheels and between said front wheels and said rear wheels; and wherein said rear motor is closest to said rear wheels and said front motor is closest to said front wheels;

means for coupling said rear motor to said rear wheels and for coupling said front motor to said front wheels.

14. The utility vehicle of claim 13 wherein said means for raising said free end of said entry tube comprises:

a partial gear mounted on an under side of said frame;

a worm gear engaging said partial gear;

said means for coupling includes means for selectively decoupling said rear motor from said rear wheels and coupling said rear motor to said worm gear, said partial gear, worm gear and means for coupling all arranged in operable combination to raise said free end of said entry tube when said means for coupling is selectively coupled to said worm gear.

15. The utility vehicle of claim 3 wherein said means for raising said free end of said tube comprises:

an extension of said tail section of said tube over hanging said another end pivotally attached to one end of said means for supporting;

a hydraulic ram mounted on said means for supporting said tube;

said ram having a piston;

means for energizing said ram to force a piston of said ram against said extension arranged to rotate said tube about said pivot axis.

16. The utility vehicle of claim 3 comprising:

a cab door between said tail section and said cab section.

17. The utility vehicle of claim 3 comprising:

an entrance door at said pivotal end of said tail section.

18. The utility vehicle of claim 17 wherein said entrance door comprises:

said entrance door having an opening;

a fan mounted on said entrance door and arranged to force air through said opening and out of said cab section.

19. The utility vehicle of claim 3 comprising:

a fan mounted close to said tail and arrange to force air from outside said entry tube, up through said entry tube and out through said cab section.

20. The utility vehicle of claim 3 comprising:

a cab door between said tail section and said cab section;

an entrance door at said pivotal end of said tail section;

a capped opening in a ceiling of said tail section;

said cab door constructed and said rear door constructed to permit filling said tail section with water when said cab door and entrance door are closed.

21. The utility vehicle of claim 3 comprising:

a cab door between said tail section and said cab section;

an entrance door at said pivotal end of said tail section;

a capped opening in a ceiling of said tail section;

a fan mounted on an outside of said entrance door and arranged to force air through an opening in said entrance and out of said cab section;

a vent door mounted on an inside surface of said entrance door and arranged to close said opening;

said cab door, said entrance door, said vent door constructed to permit filling said tail section with water when said cab door, entrance door and vent door are closed.

22. The utility vehicle of claim 2 wherein said means for supporting comprises:

a plurality of wheels;

a frame mounted on said plurality of wheels;

said tube having a tail end pivotally attached to an end of said frame.

23. The utility vehicle of claim 22 wherein said entry tube comprises:

a tail section having a pivotal end pivotally attached to pivot axis mounted on a rear end of said means for supporting;

a cab section having means for hingeably attaching said cab section to said opposite end of said tail section;

said cab section having a floor section that is joined to said cab section and is elevated when said cab section is elevated;

another floor section permanently mounted on another floor section;

said means for controlling mounted on said another floor section providing that an operator is enabled to operate said means for driving when said cab is is enabled to operate said means for driving when said operator is near said ground support surface.

24. The utility vehicle of claim 1 comprising a ladder slidably mounted on a roof of said entry tube and arranged to slidably extend in a direction over said cab section.

25. The utility vehicle of claim 1 comprising:

a capstan mounted on said entry tube;

a cord wrapped around said capstan and having a free end attached to said ladder operably arranged to enable extending said ladder over said cab section.

26. The utility vehicle of claim 1 comprising:

a hose, means for storing said hose on an outside of said entry tube.

27. The utility vehicle of claim 26 further comprising:

a pump mounted on said utility vehicle and connectable to said hose; and connectable to a source of water;

means for supplying power for operating said pump.

28. The utility vehicle of claim 1 wherein said height is 26 feet.

* * * * *